US005241790A

United States Patent [19]

Schimpf

[11] Patent Number: 5,241,790

[45] Date of Patent: Sep. 7, 1993

[54] KICK-PROOF DOORJAMB REINFORCING MEANS AND ASSEMBLY

[76] Inventor: George A. Schimpf, 80 Belden La., Centerville, Mass. 02632

[21] Appl. No.: 935,513

[22] Filed: Aug. 25, 1992

[51] Int. Cl.[5] ..... E06B 1/04; E05C 21/02

[52] U.S. Cl. ..... 49/504; 49/460; 49/506; 52/514; 292/340

[58] Field of Search ..... 49/504, 460, 506, 462; 52/514; 292/340, 346

[56] References Cited

U.S. PATENT DOCUMENTS

| | | | |
|---|---|---|---|
| 3,815,945 | 6/1974 | Lamphere | 292/340 |
| 3,918,207 | 11/1975 | Aliotta | 49/504 |
| 4,057,275 | 11/1977 | Le Beaud | 49/504 X |
| 4,174,862 | 11/1979 | Shane | 292/346 |
| 4,684,160 | 8/1987 | Nelson | 292/340 |
| 4,770,452 | 9/1988 | Petree, Jr. | 292/504 X |
| 4,802,701 | 2/1989 | Mazie | 292/346 X |
| 4,854,621 | 8/1989 | Baldwin | 49/504 X |
| 4,858,384 | 8/1989 | Blankenship | 49/504 X |
| 5,003,727 | 4/1991 | Watten | 49/504 |

*Primary Examiner*—Philip C. Kannan
*Attorney, Agent, or Firm*—O'Keefe & Wilkinson

[57] ABSTRACT

A reinforcing plate for reinforcing a doorjamb to prevent break-ins and particularly kick-ins of the door by unauthorized persons is mounted in back of the doorjamb in the space between the jamb and the door frame. In order to install the reinforcing plate behind the doorjamb, the interior trim strip is removed from the door frame and the reinforcing plate is mounted behind the doorjamb, preferably by the use of shims to temporarily jam the plate between the doorjamb and the door frame. While the reinforcing plate is temporarily secured by a wedging means against the back of the door frame, holes are drilled in the door frame and through the reinforcing plate using appropriately-sized drill bits. Self-tapping threaded screws are then passed through the doorjamb and screwed tightly into the reinforcing plate the attach the plate to the doorjamb and reinforce the jamb. As an alternative, special fastenings are provided to fasten the striker plate to the reinforcing plate.

20 Claims, 3 Drawing Sheets 19
23
21
17
15
11
25
37
37
37B
37C
37
29
35
13
31
37
35

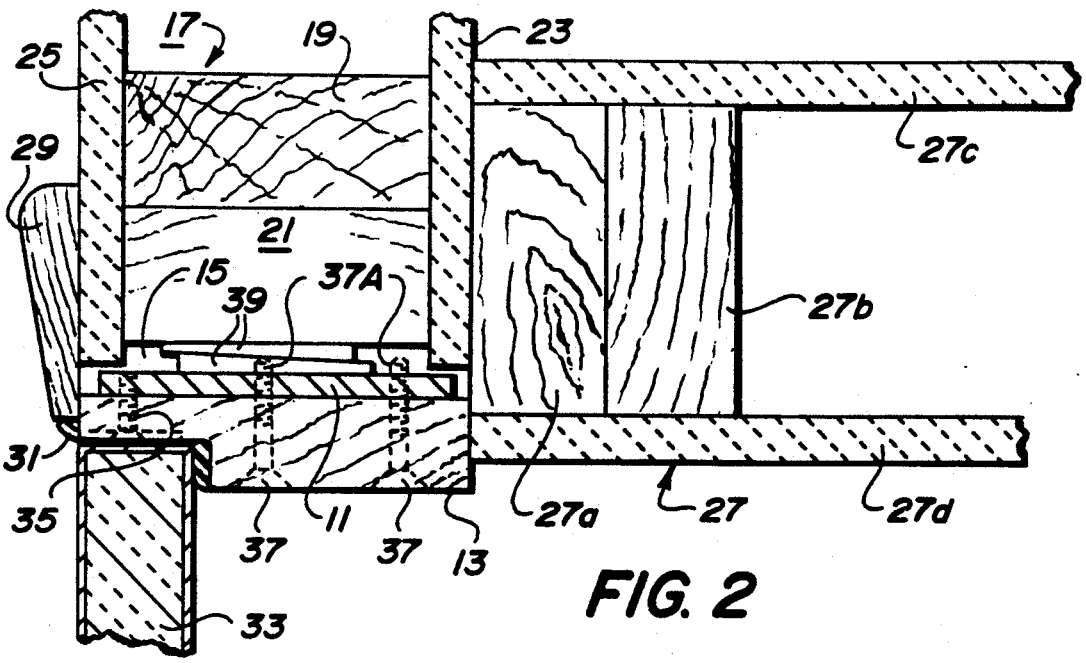
FIG. 2
FIG. 3
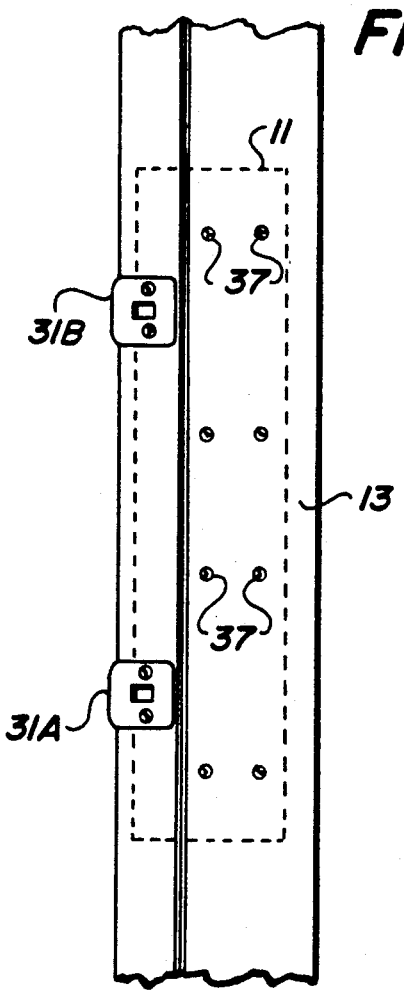
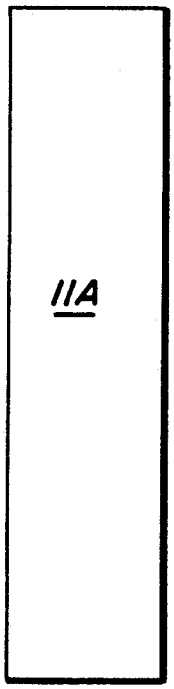
FIG. 4
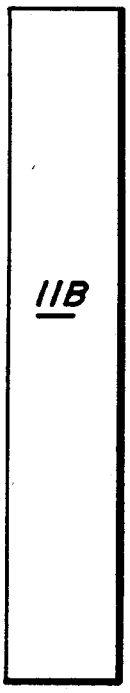
FIG. 5

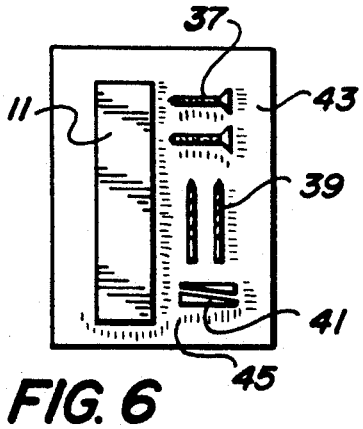
FIG. 6
FIG. 7
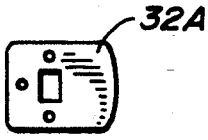
FIG. 8
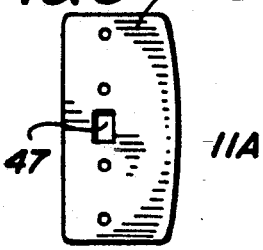
FIG. 9
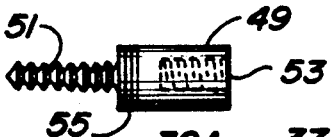
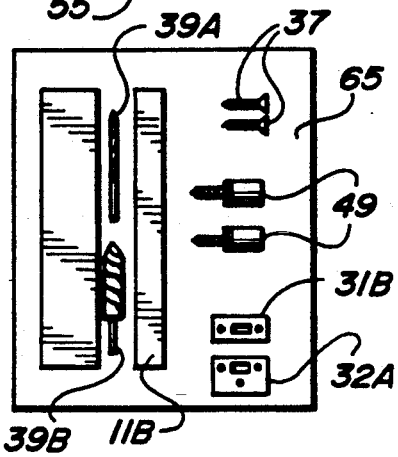
FIG. 14
FIG. 10
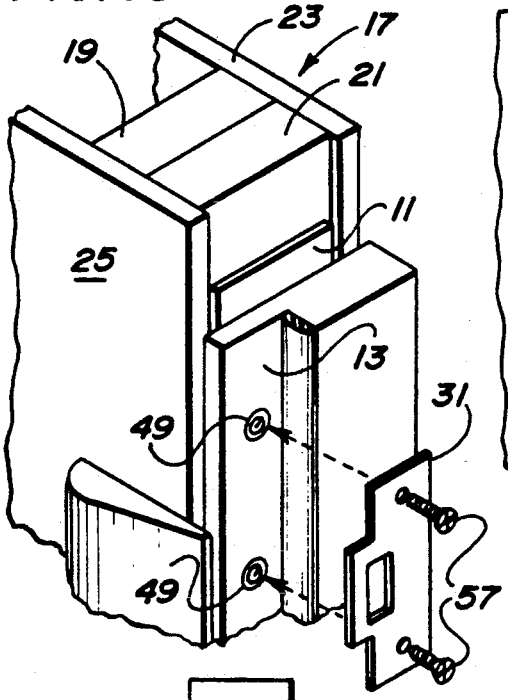
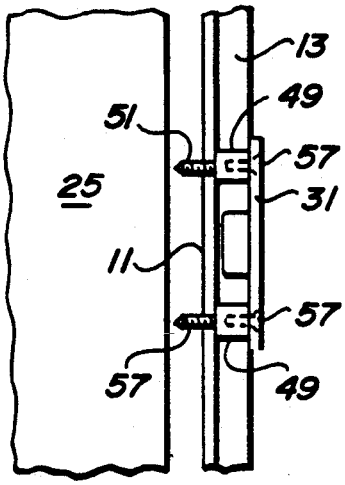
FIG. 11
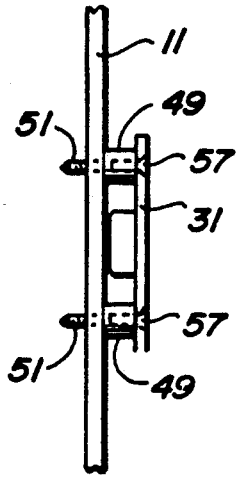
FIG. 12
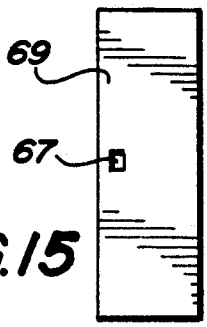
FIG. 15
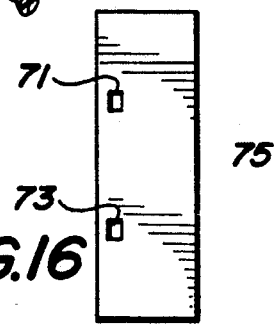
FIG. 16
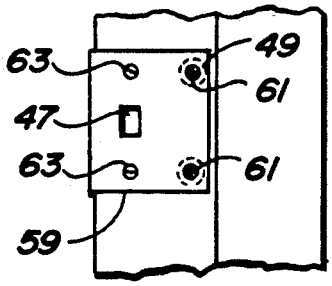
FIG. 13

KICK-PROOF DOORJAMB REINFORCING MEANS AND ASSEMBLY

BACKGROUND OF THE INVENTION (1) Field of the Invention

This invention relates to anti-burglary devices and more particularly to the provision in a convenient retrofitable form of a reinforcing means for the doorjambs of residences and the like.

(2) Discussion of the Prior Art

One of the prime methods of entering residences and other buildings by burglars and strong-arm men, not to say law enforcement personnel who wish to take the occupants by surprise, is a simple kick to the door near the bolt or latch. Since the striker plate into which the latch of the door slides is usually merely bolted to the doorjamb about a routed-out orifice in the doorjamb, a well placed kick will usually break the striker plate from the doorjamb fracturing the jamb in the process and allowing the door to fly open. This is as true with modern steel-cased doors as with older doors, since the striker plate is positioned invariably along the edge of the jamb with only a minimum of wood about the latch opening which the striker plate is supposed to reinforce.

A great number of arrangements have been invented in the past for reinforcing the doorjamb in the striker plate area, many of which have been relatively effective, but none of which have achieved any substantial use due to impracticalities in their design and implementation.

Among the arrangements that have been tried and found wanting due to impracticality, even though effective in reinforcing the door, are those disclosed in the following patents:

U.S. Pat. No. 3,338,008 issued Aug. 29, 1967 to S. Sklar discloses a so-called knock-down door buck construction comprising a method of forming and installing a doorjamb and head piece. The arrangement is comprised of preformed pieces and includes metal clips which are attached to the frame of the door and incorporate flanges which extend outwardly into grooves in the trim strips on the side of the door frame.

U.S. Pat. No. 3,767,245 issued Oct. 23, 1973 to John N. Keefe discloses a reinforced striker plate for a doorjamb. The striker plate of Keefe has an elongated extension along one side which may be mounted flush against the doorjamb under the door's stop striping. The arrangement provides essentially a reinforced striker plate.

U.S. Pat. No. 3,815,945 issued Jun. 11, 1974 to E. R. Lamphere discloses a combined reinforcing plate and striker plate in the form of an expanded or reinforced striker plate having a shape arranged to extend over a fairly large portion of a doorjamb and an integral door stop upon the doorjamb. The expanded combination striker plate and reinforcing plate are held against the doorjamb by means of screws extending completely through the doorjamb and into the studding of the door frame. The reinforced striker plate and reinforcing plate preferably has small flanges along the edges to aid in engaging with the doorjamb.

U.S. Pat. No. 3,918,207 issued Nov. 11, 1975 to P. Aliotta discloses a doorjamb reinforcing arrangement in which the jamb is backed by a metal plate which may extend essentially across the entire rear of the jamb and, if necessary, from one end to the other of the jamb. The metal plate is provided with spaced fastening holes and may be fastened either by screws or bolt-type fastenings which pass either from the rear of the plate through the pre-drilled holes in the plate into the back of the doorjamb or alternatively by bolts which pass from the front of the doorjamb through the jamb into and through the reinforcing plate on the rear. A jamb reinforcing plate is also provided with a flange along one side to reinforce the side of the jamb closest to the one side to reinforce the side of the jamb closest to the striker plate hole. Either the side of the jamb or the back of the trim strips must be routed out on the side where the flange is provided in order to provide a tight fitting connection. The practicality of the Aliotta plate is consequently severely compromised by the necessity for performing operations which are inconvenient and difficult to carry out in the field.

U.S. Pat. No. 3,963,269 issued Jun. 15, 1976 to S. R. Rosenberg discloses a door strengthening arrangement including a metal casing which passes around the outer portion of a doorjamb, including a door stop arrangement. A special slotted reinforcing plate is mounted directly upon the door and when the door is closed, an extension from the striker plate passes through the slotted member on the door and aids in preventing the door and the doorjamb from being sprung apart by means of a crowbar or the like. One small section of the expanded striker plate is designed to extend around the front of the doorjamb and interlock with the back of the jamb.

U.S. Pat. No. 3,967,845 issued Jul. 6, 1976 to B. C. Governale discloses the use of an expanded reinforcing plate positioned over the latch orifice to basically reinforce the front of the doorjamb about the latch orifice. A conventional striker plate is mounted directly over the reinforcing plate and substantially obscures the reinforcing plate from outside view. The reinforcing plate is therefore substantially concealed from view both by being under the conventional striker plate and also having its expanded section on one side hidden under the weather stripping which normally is provided along the jamb adjacent to the doorstop.

U.S. Pat. No. 4,057,275 issued Nov. 8, 1977 to L. J. La Beaud discloses an elongated metal reinforcing plate fastened to the back of a wooden doorjamb to reinforce the doorjamb opposite to a conventional striker plate. The La Beaud plate has angled teeth which extend into the doorjamb from the back. A flange is provided on one side of the La Beaud reinforcing plate forming an angled lip extending along one side of the plate. This lip is arranged to catch behind the latch of the door and extends on both of the latch sides in an opening or slot in the doorjamb.

U.S. Pat. No. 4,174,862 issued Nov. 20, 1979 to C. F. Shane discloses a door frame reinforcing plate in which a metal plate is provided on the back of the doorjamb. The lock bolt extends completely through the jamb and through an orifice in the metal plate. A bent-over section of the reinforcing plate also is extended over the outside end of the doorjamb. In a more preferred embodiment, furthermore, an additional extension of the metal plate is bent around the back of the two by fours (2"×4"s) of the door frame so that the metal reinforcing plate takes the form of a U-shaped plate which almost completely surrounds the timbers of the door frame.

U.S. Pat. No. 4,195,870 issued Apr. 1, 1980 to J. Percoco discloses a striker plate reinforcing arrangement. There are several embodiments of the Percoco device including the use of a block-type striker plate providing a heavier section into which the latch bolt extends. Such block-type striker plate is attached in various ways to other portions of the door.

U.S. Pat. No. 4,295,299 issued Oct. 20, 1981 to D. M. Nelson discloses a J-shaped reinforcing plate having the major arm on the back of the doorjamb and the minor arm on the front of the doorjamb with a connecting web extending along the outer end of the doorjamb. The reinforcing plate is applied to the doorjamb by removing the outer trim and apparently a groove is also provided in the front of the doorjamb also to accommodate the end of the minor arm of the plate section. No space is shown behind the doorjamb into which the rear portion of the reinforcing plate fits. The Nelson patent shows a fastening in the form of a nail passing from the front of the doorjamb through the doorjamb into and through the major arm of the reinforcing plate extending along the back of the jamb. It is not quite clear how the nail is forced into the plate. Nelson does constitute a broad disclosure of having a reinforcing plate extending along the rear of a doorjamb and a fastening extending from the front of the doorjamb through the plate to hold it in place against one of the framing two by fours (2"×4"s) of the door frame.

U.S. Pat. No. 4,383,709 issued May 17, 1983 to T. O. Ronan discloses a striker plate which in one embodiment completely ensheaths a section of the outer portion of a doorjamb. The main thrust of the Ronan patent is to provide a blocking plate adjacent to the lock to prevent tools from being inserted from the outside to spring the bolt.

U.S. Pat. No. 4,416,087 issued Nov. 22, 1983 to P. K. Ghatak discloses a reinforcing plate mounted along the edge of a doorjamb to reinforce such jamb against fracture by a sharp kick or the like. Long bolts are shown extending from the heavy reinforcing plate longitudinally across the doorjamb into a bolt or nut opening near the opposite side of the doorjamb. Ghatak indicates his reinforcing method very effectively reinforces the doorjamb against the type of force which is usually used to kick open a door.

U.S. Pat. No. 4,684,160 issued Aug. 4, 1987 to G. J. Nelson discloses a reinforcing plate for use on the back of a doorjamb in conjunction with the usual striker plate on the front of the doorjamb. The reinforcing plate is designed to be attached to the frame members of the doorjamb and has the further elaboration of having a reinforced chute or column passing through the doorjamb in the vicinity of the striker plate which reinforced chute or column the latch bolt enters to provide a secure locking arrangement.

U.S. Pat. No. 4,717,185 issued Jan. 5, 1988 to R. A. Hartley discloses a combined striker plate and reinforcing plate which has side extensions extending inwardly along the sides of the two by four (2"×4") framing members of the door frame. A forward extension from the striker plate surface also serves to reinforce the door stop of the door. Hartley specifically discloses that his arrangement is designed for new construction where the combined striker plate and reinforcing plate can be conveniently mounted on the original door frame.

U.S. Pat. No. 4,770,452 issued Sep. 13, 1988 to R. W. Petree discloses a reinforcement plate inserted into a groove in the doorjamb to reinforce such doorjamb. The plate is secured also directly to the framing members by a long threaded connector. The reinforcing plate, which is inset into a routed out portion of the doorjamb, is fairly long so it reinforces a large portion of the doorjamb. An ordinary striker plate is normally used on the outside of the doorjamb. Petree makes a point of the fact that his reinforcing plate can be retrofitted into existing structures. Petree states that in his invention only the outer doorjamb is removed and the security plate is installed into a groove routed out in the doorjamb without direct engagement or modification of any of the underlying support studs in the wall about the door frame.

U.S. Pat. No. 4,802,701 issued Feb. 7, 1989 to G. S. Mazie discloses a reinforcement plate for a lock which plate is installed behind the doorjamb. The reinforcing plate has a groove in it which receives a right angle bend on the doorjamb through the groove in the reinforcing plate and into a groove formed in the underlying frame of the door. Various screw fastenings may be used to mount the reinforcing plate directly upon the two by four (2"×4") frame members of the door and a transverse screw member may be used to secure the right angled bent portion of the special striker plate in the groove.

U.S. Pat. No. 4,854,621 issued Aug. 8, 1989 to R. L. Baldwin discloses a combined striker plate and reinforcing plate arrangement in which an extended portion of the striker plate is bent into a "U" shape which passes about the doorjamb to basically reinforce the jamb itself. The arrangement is somewhat analogous to the Shane arrangement in which a plate passes across the back of the doorjamb and then is bent around the beams in the door frame rather than about the doorjamb itself. Baldwin has a further preferred arrangement comprising an angled plate arranged to be secured to the door frame itself and extend along the edge of the door frame over the plate extending around the back of the jamb. The jamb plate, in this way, is held securely to the door frame. Baldwin discloses he can also use the U-shaped striker plate alone without the additional security of the angled plate which normally holds the striker plate to the door frame members themselves. In such simplified embodiment, as noted above, the arrangement would appear to be primarily a reinforcement of the doorjamb. Baldwin discloses his arrangement is relatively easy to install. In new buildings, the U-shaped striker member and the angled tie plate can be positioned prior to attachment of the wooden trim or molding in the doorway. In existing doors, on the other hand, the existing striker plate is first removed and the door trim or molding is removed so that the striker plate member can be placed around the inner edge of the doorjamb while the tie plate member is hooked over the outside of the wall next to the doorway so that one leg extends between the door frame and the arm of the striker plate. The door trim molding is then secured to the doorway by screws to anchor the two members together.

U.S. Pat. No. 4,865,370 issued Sep. 12, 1989 to C. E. Francis discloses a boxed-in reinforced striker plate orifice. The reinforced boxing is attached to an anchor plate "preferably secured by long screws extending through the jamb into the trimmer stud". The reinforced striker bolt receiving chamber, referred to as an "anchor pocket", extends from the anchor plate side of the doorjamb forming an orifice in the jamb into which the deadbolt is extended. It is said that forceful entry is prevented since the anchor plate strengthens the doorjamb, "thus giving a very strong structural combination which can resist a rather strong splitting force caused by an attempted forceable entry". Francis uses shims in FIG. 7 and in FIG. 9 to retain the anchor plates against the rear of the jamb, evidently while a screw is turned into and through the reinforcing plate. In FIG. 8, the reinforcing plate is shown with a series of orifices for allowing passage of the screws through the plate.

U.S. Pat. No. 5,003,727 issued Apr. 2, 1991 to E. Watten discloses the use of a direct reinforcement of a striker plate by removing or mortising out a portion of the doorjamb under the striker plate and inserting into such portion a metal reinforcing element which may be a bent-over portion of a backing plate or a metal piece welded onto a backing plate which extends along the rear portion of the doorjamb. The reinforcing or backing plate on the back of the doorjamb is shown in FIGS. 4*a* and 4*b* as being secured to the jamb either by helical screws extending from the rear into the back of the jamb or from the front of the jamb through the reinforcing plate into the door opening.

While there has been broad recognition, therefore, that some practical means for reinforcing doorjambs against fracture due to kicks and the like intended to either spring open the door or to fracture the doorjamb and allow the door to swing open, would be desirable, such arrangements as have been tried have not proved to be really practical and consequently have been used little, if at all. In particular, the prior art has not embodied a reinforcing arrangement which can be easily mounted by relatively unskilled labor on either old installations of doors or new installations of doors and has not been sufficiently practical to encourage those in the art to provide the reinforcing means as a standard in house construction. Nor has there been an arrangement or method that could be retrofitted to existing door assemblies by relatively unskilled labor such as the usual homeowner.

There has been a clear need, therefore, for a simple, practical method and means for reinforcing the doorjambs of both existing buildings and new buildings to prevent the door from being broken open relatively easily by exposure to sharp blows such as may be delivered by a swift kick or other forceful entry-inducing force.

BRIEF DESCRIPTION OF THE INVENTION

The present invention provides a reinforcing kit for reinforcing doorjambs to prevent their fracture around the striker plate by the application of a sharp force such as may be delivered by a kick or other forceful blow. The arrangement of the invention provides a reinforcing plate as part of a kit together with threaded-type, self-tapping fastenings and a drill bit arranged to be used with such fastenings to provide orifices through the doorjamb and directly into the reinforcing plate, which has been installed at the rear of the doorjamb. The door reinforcing plate is held in position during installation and to some extent subsequent thereto, by the use of a jamb-type or wedging support means which may comprise several triangular shims which temporarily jam the plate in position while it is being drilled. Self-tapping screws, or other self-tapping, threaded fasteners for passage into the drilled holes in the jamb and in the backing plate, are also provided. These self-tapping fasteners should also be provided with non-reversible or one-way heads.

The invention also provides a method for securing a backing plate or reinforcing plate to a doorjamb. In a variation of the invention, a special base arrangement for attaching the striker plate of the door directly to the reinforcing plate through direct steel contact is provided by reason of cylindrical backing members which may be screwed into the backing plate with self-tapping screws and serve as a solid base upon which the striker plate may be screwed directly to the reinforcing plate. In most cases, however, if the self-tapping screws are used to pull the striker plate forcefully against the side of the doorjamb so that the wood of the doorjamb is force-fully compressed between the striker plate structure and the reinforcing plate structure, the wood of the doorjamb being compressed serves in itself as a composite structure having great strength which prevents the striker plate from being broken out from the doorjamb by a severe external force such as a sharp kick or the like due to the reinforcement arrangement. The specific aim of the invention is to provide a practical doorjamb reinforcing arrangement which can be used easily in the field, including the retrofitting of existing structures by relatively unskilled labor, including owners of the building itself as well as professional builders and the like, and such builder's carpenters and other less skilled workers. The final reinforced door assembly comprised of a reinforcement plate on the rear of the doorjamb pulled tightly against the jamb and attached firmly to the striker plate by threaded fasteners, of which at least the fasteners passing directly from the doorjamb into the reinforcing plate are self-tapped, threaded fasteners, provides a very strong arrangement or assembly which, even though simple and economical, successfully resists strong-arm-type breakage of the doorjamb and associated structures and particularly successfully resists sharp blows such as kicks and the like.

BRIEF DESCRIPTION OF THE DRAWINGS

FIG. 2 is a top view partially in section of a doorjamb showing the reinforcing plate of the invention secured in place.

FIG. 3 is a side view of a doorjamb from the plane of the jamb indicating by dotted lines the position of the reinforcing plate of the invention with respect to two striker plates secured to the doorjamb.

FIG. 4 is a side view of a reinforcing plate in accordance with the invention for reinforcing a wide doorjamb.

FIG. 5 is a side view of a reinforcing plate for reinforcing a smaller doorjamb such as may be used on relatively narrow door structures having side windows or the like beside or otherwise adjacent to the door.

FIG. 6 is a plan view of a kit including the reinforcing plate of the invention together with the securing screw fastenings and drill bits and the like for mounting such reinforcing plate in place on a doorjamb.

FIG. 7 is a side view of a wider-than-normal striker plate such as may be used with the present invention.

FIG. 8 is a side view of an extended striker plate which is preferred for use in the invention.

FIG. 9 is a view of a reinforcing fastening member for use between the striker plate of the invention and the underlying reinforcing plate.

FIG. 10 is an isometric view similar to FIG. 1 showing the reinforcing screw-threaded members of FIG. 9 installed in place ready for the installation of the striker plate.

FIG. 11 is a side view of the arrangement shown in FIG. 10, partially in section, showing the reinforcing members of FIG. 9 extending through the short section of the door jamb.

FIG. 12 is a side view of the arrangement of the invention shown in FIGS. 10 and 11 with the jamb reinforcing plate, reinforcing screw-threaded members and striker plate assembled together as they are assembled in or about the door jamb, the wooden members of which have been left off for clarity.

FIG. 13 is a side view of an alternative embodiment of the invention in which the special reinforcing fastenings of FIG. 9 are used at a location on or adjacent to the striker plate away from the edge of the doorjamb.

FIG. 14 shows a kit in accordance with the invention including, along with the essentials of such kits, alternative wide and narrow jamb reinforcing plates, the reinforcing screw threaded means of FIG. 9 and alternative striker plates.

FIG. 15 is a side view of an alternative jamb reinforcing plate in accordance with the invention wherein the plate has a prefabricated hole for a long lock bolt.

FIG. 16 is a side view of an alternative jamb reinforcing plate embodiment similar to that shown in FIG. 14, but including two prefabricated long lock bolt orifices.

DESCRIPTION OF THE PREFERRED EMBODIMENTS

Figure 1:
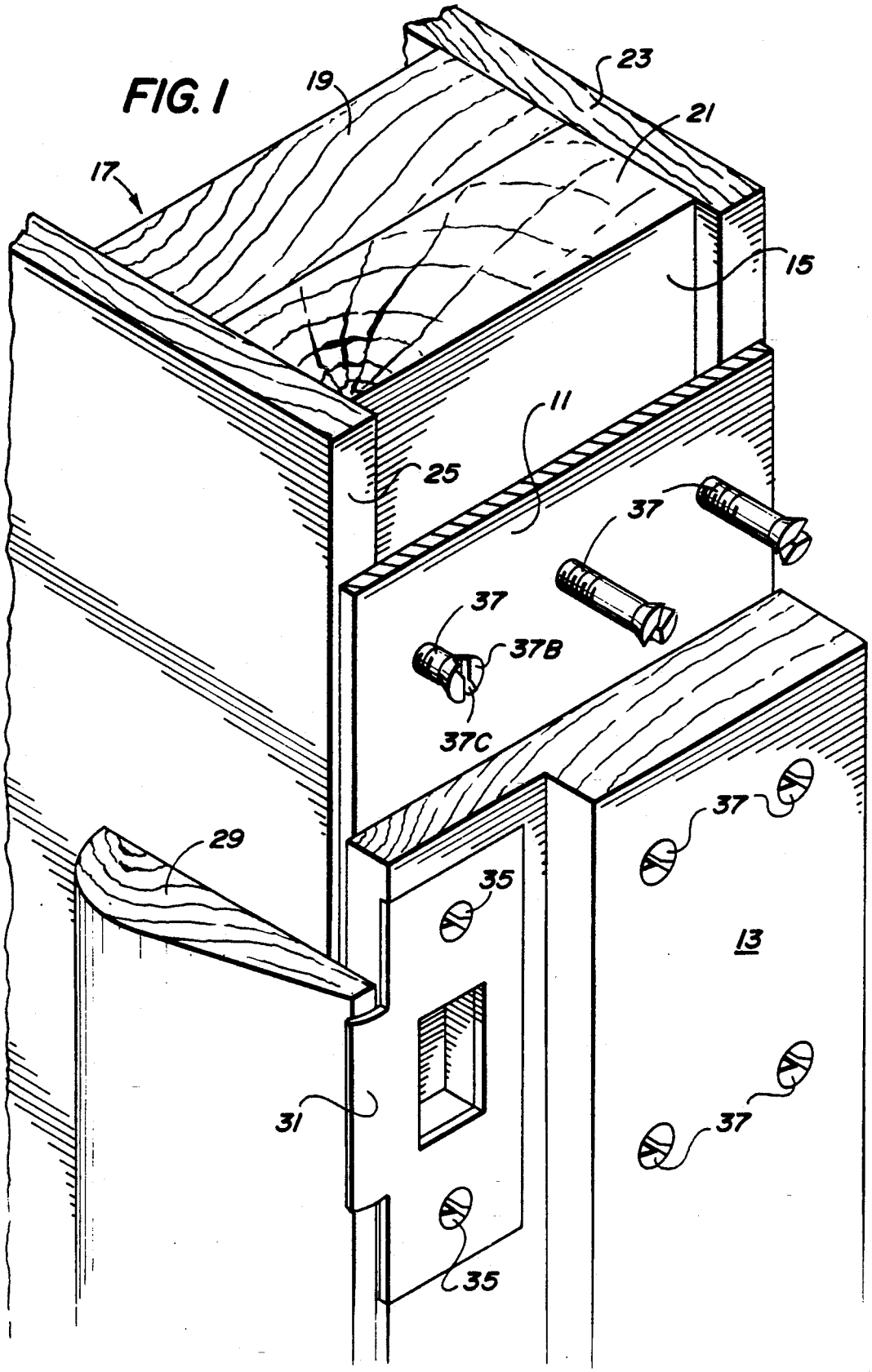
FIG. 1 is an isometric view of a typical doorjamb arrangement partially broken away to show the jamb reinforcing plate of the invention installed in place against the back of the jamb.

As reviewed above, there have been a number of devices and means suggested for the reinforcement of doorjambs and striker plate orifices in order to reinforce the locking of a door and particularly to prevent a door from being broken down by persons wishing unauthorized access to residences and other enclosures While some of the arrangements suggested in the prior art for strengthening doorjambs and other portions of the door frame have not been too effective, a number, in fact, have been quite effective in strengthening the door and preventing it from being sprung open with a sharp blow or kick. However, so far as the present inventor is aware, all of such prior devices have been difficult to apply and/or expensive to such a degree that few have ever been used extensively, if at all. In particular, the devices of the prior art have been largely impossible to conveniently retrofit into an existing door frame structure without major modifications. Also, such devices have not lent themselves to use even by builders, because the devices have either been so expensive that few builders have wished to provide them or so complicated to install that builders have not wished to become involved with them due to the relatively unskilled labor which is frequently used for such installation-type work.

Homeowners, on the other hand, are usually relatively unsophisticated concerning the hidden portions of their homes and while home mechanics frequently have sufficient perseverance and time as well as the funds to install effective strengthening means for doorjambs and door frames and the like, their lack of knowledge concerning what lies behind the walls and facings of their home makes it relatively difficult to install most devices which require any modification at all to the structure and trim of their home.

The present inventor has discovered and devised a new arrangement and method for strengthening the doorjamb of a door assembly which makes it very difficult to fracture the doorjamb as is usually necessary to kick down the door. The arrangement and method, furthermore, are simple, effective and easy to use both by relatively unskilled and unmotivated labor and interested, but relatively inexperienced and unknowledgeable homeowners and home handymen. Applicant provides for this purpose, a simple strengthening plate of fairly heavy gauge such as 16 gauge steel plate which is supplied beforehand only with lock bolt openings or the like, if necessary. Such plate is designed to be installed in the normal opening between a doorjamb and the door framing members, which opening is invariably provided in order to allow the door to be plumbed or matched to the opening during installation. The plate is deliberately not pre-drilled, since it is difficult to line up fastenings in a doorjamb with pre-drilled fastening openings in the plate. Instead, the plate is shimmed into position and held by shims or wedges in position while a drill is used to drill directly through the face of the doorjamb into the plate at the locations at which it is desired to secure the plate to the doorjamb. Self-tapping one-way fastenings are then threaded through the bores drilled in the doorjamb directly into the plate where they thread into the plate and hold it securely against the doorjamb. The plate is thus securely held in place and reinforces the jamb. Openings are also drilled through the striker plate screw holes directly into the reinforcing plate and the striker plate is then secured firmly to the reinforcing or backing plate by the same self-tapping threaded fastenings. Alternatively, the striker plate on the door may be secured to the backing or reinforcing plate by machine bolt fastenings which are easily accessible from the side of the doorjamb if the trim or interior casing over the door frame is removed. As a further alternative, special fastenings having a fairly wide base or supporting surface at both ends can be provided as a connecting means between the striker plate and the reinforcing plate on opposite sides of the doorjamb. These reinforcing means are fitted into simple drilled orifices extending through the doorjamb and provide both a metal-to-metal contact between the parts as well as a strong and secure boxlike structure arrangement.

The reinforcing plate and fastenings of the invention are preferably supplied to the trade in a prepackaged form including the necessary plate, one-way fastenings and matching sized drill bits for installation of the plate and fastening against the door jamb. A more complete understanding of the invention will be gained by reference to the following detailed description with reference to the appended drawings.

FIG. 1 is an isometric view of a portion of a typical door frame partially broken away to show the reinforcing plate of the invention 11 positioned on the back of the doorjamb 13 within the space 15 normally found between the doorjamb 13 and the door frame 17. The door frame 17 is composed or formed, as is customary, from a pair of two by four timbers 19 and 21 to the sides of which are placed encasing timbers or sheet members 23 and 25, the whole forming a part of the door frame or door frame assembly. The encasing member 23 may be exterior sheathing or siding and the encasing member 25 may be drywall or plaster or lath or the like. A section of an exterior door casing 27 extends away from the door frame 17 proper. See FIG. 2. This casing, in the case shown in FIG. 2, is comprised of a fairly heavy construction comprised of two by fours 27*a* and 27*b* with outer casings 27*c* and 27*d*. This entire structure 27 may be part of an archway or overhang over the door and serves as an excellent outside protection for the inner portions of the door frame. A door trim piece or interior door casing 29 covers the side of the door basically covering the space between the frame 17 and the doorjamb 13. In many constructions, the exterior door casing 27 may not be present except as an outside trim casing similar to the inside trim casing 29, but usually more extensive and more securely attached to the door frame. A striker plate 31 is provided on the outside of the doorjamb 13 in a position to interact with the latch or bolt of the door lock normally held in the door 33 as shown more particularly in FIG. 2 which is a top-section view of the isometric view of a door assembly shown in FIG. 1.

In FIG. 2, screw threaded fastenings 35 are shown securing the striker plate 31 to the reinforcing plate 11 of the invention. Such screw threaded fastenings 35 may normally be a self-tapping fastening which, as will be presently described, also connects the reinforcing plate 11 of the invention to the doorjamb 13, reinforcing the jamb as a whole. However, it should be understood that other types of threaded fastenings such as machine bolts and the like could also be used to attach the striker plate 31 securely to the reinforcing plate 11 through the wood of the door-jamb 13. If these threaded fastenings are pulled fairly tight, the force obtained between the striker plate and the reinforcing plate upon the wood between them forms, in effect, a very strong laminated structure which is practically indestructible by any normal exteriorly applied force. Alternatively, however, as will be explained presently, a special threaded reinforcing fastening member may replace part of the wood between the striker plate and the reinforcing plate of the invention.

In FIG. 1, there are also shown a number of threaded one-way fastenings 37 which should be understood to be self-tapping fastenings which have been tapped into the reinforcing plate 11 after such plate has been predrilled. A number of suitable self-tapping fastenings are known in the art. In FIG. 1, such self-tapping threaded fastenings are shown in the top of the view extending from the plate where the jamb 13 has been cut away. In the lower portion of FIG. 1, only the heads of the self-tapping fastenings 37 are shown as they are pulled into the doorjamb, fastening it tightly to the reinforcing plate 11. Several of the self-tapping screw threaded fastenings 37 are also shown in cross section in FIG. 2 where it is seen that the leading ends 37A of such self-tapping fastenings have extended through the reinforcing plate 11 in order to obtain good purchase upon such plate. The ends 37A of the self-tapping threaded fastenings extend into the opening or space 15 behind the doorjamb. The head 37B of the self-tapping threaded fastenings 37 are as shown with so-called one-way slots 37C having the usual flat slot sides in the driving direction, but a beveled opposite slot side so a driving tool such as a screwdriver cannot gain the necessary purchase for rotation of the screw in the opposite direction to remove the screw. This prevents someone on the outside of the door from removing the fastenings to detach the reinforcing plate 11 from the doorjamb 13. If desired, the heads of the fastenings 35 can also have one-way slots, but this is not strictly necessary, since the fastenings 35 are normally shielded by the closed door in any event.

It is critical to the successful use and operation of the doorjamb assembly and reinforcing plate of the invention that the plate be attached to the doorjamb by self-tapping threaded fasteners in accordance with the present invention. These self-tapping threaded fasteners are entered into orifices drilled in the reinforcing plate after it is mounted in its final position behind the doorjamb 13. In mounting the reinforcing plate 11 behind the door frame, the trim strip or interior casing 29 is first removed from the face of the door frame 17, usually by merely prying such trim strip or interior casing away with a crowbar or the like. If the trim strip is attached by threaded fastenings to the door frame, it can be removed by initially removing said fastenings. When the door trim strip or interior door casing 29 is removed, access to the space 15 behind the doorjamb is had and the reinforcing plate 11 may be merely slipped into such space and held by triangular shims 39 shown in an end view in FIG. 2. Such shims are forced together so that their wedging action wedges the reinforcing plate 11 securely against the back of the doorjamb 13. Since the reinforcing plate 11 is a rigid plate formed of at least 16 gauge steel, it is relatively easy to wedge it against the doorjamb to hold it in place during the drilling of matching orifices through the doorjamb and through the reinforcing plate. If too thin a reinforcing plate was used, not only would it not adequately reinforce the doorjamb after being installed, but it would be more difficult to effectively jam into place by the wedging action of the shims, since the metal plate might bend in sections, particularly when the drilling pressure is applied to it through the doorjamb interfering with the drilling action and also the location of the openings which in order to be really effective and easily obtained, should be precisely lined up with the drilled orifices in the doorjamb itself. Plates having openings already formed in them for fastenings to the jamb, therefore, are not practical, since it is next to impossible, or at least very difficult, particularly for a homeowner, to line up such orifices with each other. Once the self-tapping, one-way screw-threaded fastenings 37 are pulled tight against the doorjamb by their purchase within the steel of the reinforcing plate 11, the doorjamb itself is very effectively reinforced as far as the plate 11 extends. Normally such plate should extend along the door for a considerable distance such as, for example, at least about 12 to 20 inches and up to 2 or 3 feet or more. As will be understood, the longer the reinforcing plate, the more reinforcing action will be obtained. With a reasonable-sized reinforcing plate, it will be practically impossible to kick down the door or to spring the door by kicking upon the door itself unless the bolt to the lock itself fractures or is torn from the door. There are a number of very strong wooden doors and also, at the present time, a widespread use of steel doors, so it is practically impossible when a strong door is used to detach the door from the doorjamb reinforced with the reinforcing plate of the present invention.

FIG. 3 shows a side view of the doorjamb having the usual two striker plates 31A and 31B, the striker plate 31A accommodating the normal latch or lock bolt of the door and striker plate 31B, as will be understood, being positioned to provide a locking surface for the usual secondary deadbolt frequently used in the present day to provide additional security for a door. In FIG. 3, the reinforcing plate 11 of the invention is shown in dotted outline to illustrate how extensive the area covered by such plate is and the extensive area of the doorjamb 13 which is reinforced by such plate. Again, it is emphasized that the success of the present invention requires that the reinforcing plate 11 be originally without orifices for the fastenings, or at least that sufficient closed area be available on such plate so that a number of small orifices may be drilled straight through the plate while it is mounted behind the doorjamb after which the self-tapping fastenings may be passed through the doorjamb and into the newly drilled openings allowing the reinforcing plate to then be pulled very tightly against the doorjamb by rotation of the self-tapping screw-threaded fastenings 37.

There are actually, in general, two types of door frames installed in most residences, a fairly wide-type used normally for the main entrances and a narrower-type used for side entrances and the like. Such narrower-type may also frequently be used on enclosed porches and the like and on doors mounted in combination with side windows. It is desirable, therefore, to provide two widths of the reinforcing plate 11 of the invention. These are shown in FIG. 4 which shows a plate about 20 inches long and 4 inches wide while FIG. 5 shows a plate also about 20 inches long and about 2¾ inches wide. These sizes are generally preferred, but any other size that can easily fit in the normal opening between the doorjamb and the door frame can be used. With these two preferred sized reinforcing plates, almost every normal doorjamb can be readily reinforced in accordance with the invention. It will be noted that both of the plates in FIGS. 4 and 5 are without any openings either for the self-tapping screw fastenings of the invention, or for extension of a long lock bolt through the reinforcing plate. As will be presently explained, however, openings for a lock bolt can be, in a preferred embodiment of the invention, provided ahead of time. However, it is desirable not to pre-apply openings for the self-tapping fastenings ahead of time, since such provision makes it very difficult to line up the fastenings with the holes in the jamb in the reinforcing plate. Instead, it is desirable and with respect to the present invention, substantially critical, not to provide the final holes for the self-tapping screw-threaded fastenings until the reinforcing plate of the invention is actually installed behind the doorjamb and held, preferably by a jamb-type arrangement of shims or the like. Of course, it will be understood that a pre-drilled plate having openings provided for some other purpose such as a lock bolt or the like, or for some other purpose, can be provided. However, in the present invention, the self-tapping screw-threaded fastenings 37 are most conveniently and effectively entered into freshly-drilled openings aligned with similar drilled openings in the doorjamb as a result of having been just drilled while a jamb is fixedly held against the back of the doorjamb.

FIG. 6 shows a kit for purchase from outlets for hardware supplies and the like including a reinforcing plate 11 in accordance with the invention, a pair of drill bits 39, for drilling openings in the plate 11 of the precise size for self-tapping, one-way screws or screw-threaded fastenings 37 during the time that the plate 11 is held in position as explained above against a doorjamb or the back of a doorjamb by shim means 41 or other effective means to hold the plate 11 in place while it is being drilled with the tap holes for the self-tapping fasteners 37. The various assembly parts or units mentioned are contained within the usual commercial packaging comprising, as shown, a cardboard backing 43 surrounded by the usual plastic shrink-wrapping 45 or the like. As will be realized by those skilled in the packaging arts, a number of different packaging arrangements can be used to produce the kits shown in FIG. 6. It will also be realized that various combinations of the essential parts used for practicing the invention can be included in the kit as shown generally in FIG. 6, only one such combination and arrangement being shown in FIG. 6.

FIG. 7 shows a striker plate 32A which is wider so as to accommodate more fastening openings. Such a striker plate is advantageous with the present invention, since it is important that the striker plate be fairly rigidly secured to the reinforcing plate 11.

The striker plate 32B, shown in FIG. 8, is longer than normal and may be supplied with additional fastening means upwardly and downwardly from the bolt hole 47 in the plate. As will be understood, since the reinforcing plate 11 may be from 2 to 3 feet or more in length, it may frequently be advantageous to use a longer-than-normal striker plate which can then be secured to the reinforcing plate at various locations forming, particularly when it is pulled up tight against the wood between the reinforcing plate and the striker plate, a very strong construction.

FIG. 9 is a side view of a special reinforcing fastening 49 having a self-tapping threaded member 51 on the bottom or first end for securing to the reinforcing plate of the invention, and a threaded opening 53 in the top or second end into which a normal threaded fastening usually of a machine bolt-type, can be threaded to support a striker plate with metal-to-metal contact against the reinforcing plate 11.

In the use of the reinforcing fastening shown in FIG. 9, a larger-than-normal opening is drilled with a drill bit supplied along with the other equipment in a kit, in the doorjamb and then a smaller opening for accommodating the self-tapping fastening 51 at the end is drilled in the plate 11. The distance between the bottom of the reinforcing fitting 49 and the top of such fitting should be exactly the thickness of the jamb section between the reinforcing plate 11 and the striker plate 31. Since the distance or the thickness of the doorjamb at the location of the striker plate may vary somewhat, it may be desirable to have several lengths of the reinforcing fitting 49 available. Alternatively, washers or washer-like sections 55 can be supplied or accommodated on the bottom of the fitting 49. Such washer-like sections 55 are exactly the same size as the outside of the fitting itself and an inner opening or orifice in the washer-like sections surrounds the self-tapping threaded section 51. The fitting 49 will normally be supplied with several of the washer-like sections 55 installed on it, which sections can then be removed until the reinforcing fitting 49, as a whole, is approximately the same height as the opening in the jamb of the door. It is preferable for the washer-like sections 55 to be at least partially attached to each other by some means such as adhesive, thin metal sections, or the like. The metal pieces can be thin slices, partially severed in the lower portion of the fitting, in which case a thin metal section at one side can retain all the sections together until one or more are pried off with a wedging tool or the like to shorten the entire unit.

FIG. 10 shows two of the reinforcing fasteners 49 installed in openings in the jamb 13 in position for the installation of a striker plate 31 on top of the reinforcing fastenings 49 by means of threaded fastenings 57 shown disposed next to the striker plate.

FIG. 11 is a further side view showing the installation of the reinforcing fastening means 49 to rigidly secure the striker plate 31 to the reinforcing plate 11.

FIG. 12 is a further view similar to FIG. 11 but omitting the wooden structure of the door frame and showing merely the metal portions of the assembly including the reinforcing plate 11, the reinforcing fastenings 49, the striker plate 31 and the self-tapping fastening sections 51 at the end of the reinforcing fittings 49 extending through the reinforcing plate 11 of the invention plus screw-threaded fastenings 57 which secure the striker plate to the top of the reinforcing fastenings 49.

FIG. 13 shows a special striker plate 59 having fastener orifices not only adjacent to the bolt hole 47, but shifted to the side away from the edge of the striker plate and the edge of the jamb of the door. Such auxiliary fastening openings 61 provide a convenient place to attach the striker plate 59 to the reinforcing threaded fastenings 49 described above which, in turn, are secured to the reinforcing plate 11 by the self-tapping fastening sections 51, better shown in FIGS. 9, 11 and 12. The reinforcing fastening 49 is shown in dotted lines in FIG. 13, where it underlies the striker plate 59. The striker plate 59 is also provided with the more conventional fastener openings 63 beside the bolt opening 47. The arrangement shown in FIG. 13 using the special striker plate and arrangement of the use of the reinforcing fastenings 49 solves the principal problem involved in use of the reinforcing fastenings 49 in the other embodiments, which is that since the reinforcing fastenings 49 have a larger diameter than the usual screw fastening and the usual fastening openings in the striker plate are also fairly close to the edge of the doorjamb, removal of the extra material from the doorjamb to accommodate the reinforcing fastening 49 in essence causes a weak point in the structure of the jamb itself, which weakness is not completely cured by the solid base provided by the reinforcing fastening 49. However, in FIG. 13, it will be recognized that the reinforcing fastenings 49, having been removed from the edge of the doorjamb, are now sufficiently far from such edge so that removal of the extra material from the jamb to accommodate the reinforcing fastening 49 does not seriously weaken, or in most cases, weaken at all, the doorjamb itself, and the extra metal-to-metal contact provided by the reinforcing fastening 49 provides a stronger connection of the striker plate 59 to the reinforcing plate 11 of the invention. Even though the reinforcing fastenings 49 provide a secure metal-to-metal contact between the reinforcing plate 11 and the striker plate 59, forming, in effect, a metal reinforced box-type structure independent of the intervening wood of the doorjamb, it still may be advisable or preferable to make the reinforcing fastening 49 shorter than the nominal height of the doorjamb at the point or location at which the reinforcing fastening passes through the doorjamb. This allows the striker plate to be drawn down against the reinforcing fastening 49 sufficiently to compress the wood of the doorjamb between the striker plate 59 and the reinforcing plate 11 of the invention, thus additionally obtaining security from the laminated structure formed thereby comprising a wooden compressed section held on both sides by a metal-to-metal contact through the reinforcing fitting 49 and thus gaining the strongest, most rigid possible connection of the striker plate 59 with the reinforcing plate 11.

FIG. 14 shows a further kit containing the parts necessary to practice the invention similar to the kit shown in FIG. 6, but including additional parts which may be useful or even preferred. In FIG. 14, there is shown included in a kit 65, two reinforcing plates, namely plates 11A and 11B, shown for example in FIGS. 4 and 5, which constitute respectively, a relatively wide plate 11A and a second relatively narrow plate 11B. It will be understood that the wider plate 11A will normally be used in locations where there is a wider doorjamb and the narrower plate 11B will be used in those locations in a residence or the like usually on side doors, patio doors and the like where the jamb is relatively narrow. Also included in the kit 65 are two different striker plates 31A and 31B which in the case of 32A is substantially the same as that shown in FIG. 7 and in the case of 31B, is a conventional striker plate. The special reinforcing fastening 49 shown in FIG. 9 is also included in the kit 65 shown in FIG. 14 and in fact two of such fastenings are shown. In addition there are included in the kit 65 the self-tapping, one-way fastenings 37 which are used for tightly securing the doorjamb to the reinforcing plate 11 in the form of plates 11A or 11B. It will be understood that the special reinforcing plate 59 shown in FIG. 13 could also be included in the kit 65 in FIG. 14 or for that matter in kit 43 shown in FIG. 6. Two different-sized drill bits, 39A and 39B, are shown in the kit in FIG. 14, 39A being for drilling bores for the self-tapping fastenings 37 and drill bit 39B having a larger diameter for providing bores in the doorjamb to accommodate the special reinforcing fastening 49 of the invention.

FIG. 15 shows a reinforcing plate 69 in accordance with the invention having a bolt orifice 67 for use where the bolt of a lock on the door is designed to pass entirely through the doorjamb. It will be noted that the single orifice 67 is located on the reinforcing plate 69 substantially on one side in the center. In installing such plate the orifice 67 can be fairly easily lined up with the bolt on the door and then secured in place by the self-tapping screws passing through holes drilled in both the doorjamb and the reinforcing plate by the use of the drill bit supplied in the kit. Normally the locking bolts supplied with the usual front door lock do not pass completely through the doorjamb and therefore there is no reason to have the additional orifice 67 in the backing plate for the normal lock. However, it is frequently customary to have an additional deadbolt mounted either approximately four or eight inches above the regular or normal lock to bring the deadbolt more nearly into the center of the edge of the door. The orifice 67 therefore can be adjusted to be under or in line with the deadbolt or adjacent to the deadbolt entrance point into the doorjamb to reinforce the deadbolt. Since the deadbolt is usually placed more in the center of the door than the normal locking bolt, the position of the orifice 67 is approximately correct as shown.

FIG. 16 shows a preferred form of the plate 11 of the invention arranged to be more easily adjustable for the two major distances which deadbolts are normally found placed or located from the normal locking bolt. There are two orifices 71 and 73 provided in the plate 75 shown in FIG. 16. Such location of the orifices 71 and 73 allows a more careful or accurate positioning of the plate so as to be more or less centralized with respect to the regular locking bolt as well as the deadbolt, if any, without skewing the reinforcing plate 75 too far away from its normal positioning center more or less about the regular locking bolt of the door. It will be understood that either of the plates 69 or 75 could be substituted into either of the kits shown in FIGS. 6 or 14 in place of or in addition to the plates already shown in such kits.

It will be understood from the above description of various embodiments in connection with the illustrations shown in the various figures that the present invention provides a very convenient and efficient arrangement and method for installing a reinforcing plate adjacent a lock in a door to reinforce the doorjamb against kicking open the door or other forceable entry of such door. While the invention is simple, it is also highly efficient and sophisticated in that the parts have been minimized to increase the practicality and the reinforcing arrangement is applicable to a wide variety of doors and the like. The invention depends essentially on the provision of all the essential parts in a convenient kit and the use of self-tapping screws to be driven into the reinforcing plate after it has been drilled in place to assure complete alignment between the holes drilled in the jamb and the plate. As explained above, many devices and arrangements have been suggested for reinforcing the jamb of a door against break-ins and particularly kick-ins of such door by trespasses and the like, but few of such previous arrangements have ever entered into actual use. The present applicant's invention has simplified the previous arrangements and refined their concepts down to the bare essentials providing thereby an unexpectedly efficient and effective means and method for reinforcing the doorjambs in residences and the like. The invention, furthermore, not only reinforces the doorjamb itself but also very effectively reinforces the striker plate by attaching it very securely to the reinforcing plate of the invention. Furthermore, in one somewhat more sophisticated, but also preferred arrangement the reinforcement or attachment of the striker plate with the reinforcing plate is substantially increased by the use of a flat-planed reinforcing fastening means between the striker plate and the reinforcing plate which even more effectively unifies the two into a single ridged structural assemblage.

While the present invention has been described at some length and with some particularity with respect to several described embodiments, it is not intended that it should be limited to any such particulars or embodiments or any particular embodiment, but is to be construed broadly with reference to the appended claims so as to provide the broadest possible interpretation of such claims in view of the prior art and therefore to effectively encompass the intended scope of the invention.

I claim:

1. A method of reinforcing a door assembly for resistance to forceable entry of such door comprising:

(a) removing the interior casing of said door to gain access to an adjustment space between the door frame and the doorjamb, (b) installing an elongated reinforcement plate in the adjustment space against the surface of the doorjamb facing the door frame and contiguous with the door lock, (c) holding the reinforcement plate in position against the doorjamb and drilling a plurality of cylindrical bores through the doorjamb and the reinforcement plate in line with each other, (d) threading a self-tapping screw threaded fastening having a larger final diameter than the cylindrical bore sufficient to effect a substantial interengagement with the interior of the cylindrical bore in the reinforcement plate, through the jamb and the reinforcement plate in the cylindrical orifice, and (e) rotating the self-tapping screw threaded fastening until the reinforcement plate is brought securely against the face of the doorjamb in a relationship which effectively reinforces the doorjamb.

2. A method of reinforcing a door assembly in accordance with claim 1 additionally comprising:

(f) securing a striker plate to the reinforcing plate by self-tapping screw threaded means rotated into the reinforcing plate until the striker plate is drawn tightly against the doorjamb.

3. A method of reinforcing a door assembly in accordance with claim 2 wherein the reinforcement plate is held in position against the doorjamb during drilling of aligned bores through the doorjamb and the reinforcement plate by means of wedging means between the reinforcement plate and the door frame members.

4. A method of reinforcing a door assembly in accordance with claim 3 wherein the self-tapping screw threaded means are one-way screw means and are rotated by a driving means only in a driving direction pulling the reinforcing plate securely against the doorjamb.

5. A method of reinforcing a door assembly in accordance with claim 3 wherein reinforcing fastening means having substantially flat upper and lower surfaces with a self-tapping threaded fastener projecting from the lower surface and a threaded orifice in the upper surface are used to at least partially secure the striker plate and the reinforcing plate together, the reinforcing plate and striker plate being drawn by threaded means into close contact with opposite flat upper and lower surfaces of said reinforcing fastening means.

6. A method of reinforcing a door assembly in accordance with claim 5 wherein the self-tapping screw threaded means are one-way screw means and are rotated by a driving means only in a driving direction pulling the reinforcing plate securely against the doorjamb.

7. A reinforced door assembly resistant to forceable entry comprising:

(a) a doorjamb and a door frame spaced from each other, (b) a reinforcing plate screw fastened to the face of the doorjamb by means of self-tapping screw means extending through the doorjamb into the reinforcing plate, said self-tapping threaded means having a tapered threaded surface interlocked into grooves cut into the circumference of a prior drilled cylindrical bore accurately aligned between the doorjamb and the reinforcing plate, and (c) threaded fastening means extending from a striker plate on the outside of the doorjamb to the reinforcing means on the inside of the doorjamb and effectively tying the two together.

8. A reinforced door assembly in accordance with claim 7 wherein the self-tapping screw means are one-way screw fastener means.

9. A reinforced door assembly resistant to forceable opening in accordance with claim 7 additionally comprising:

(d) reinforcing fastening means comprised of:

(i) a central body portion having substantially planar first and second ends, (ii) a self-tapping threaded fastening means extending from the first end and having a substantially smaller diameter than the central body portion, (iii) a threaded orifice in the opposite secured end of said central body portion, and (e) said reinforcing fastening being connected by said self-tapping threaded fastening means to said reinforcing plate at said first end and by a threaded fastening means to the striker plate at its second end with the first and second ends pulled against the reinforcing plate and the striker plate respectively.

10. A reinforced door assembly in accordance with claim 9 wherein the self-tapping screw means are one-way screw fastener means.

11. A reinforced door assembly resistant to forceable entry in accordance with claim 10 additionally comprising one or more lock and deadbolt orifices in the reinforcing plate.

12. A reinforced door assembly resistant to forceable entry in accordance with claim 11 wherein the reinforcing plate extends at least ten inches on a vertical direction on either side of said striker plate.

13. A kit comprised of parts for a door reinforcing assembly comprising:

(a) a container composed substantially of a flexible material, (b) a doorjamb reinforcing plate having a greater length than breadth with no effective fastening orifices in said plate, (c) a drill bit adapted for drilling an aligned bore in said reinforcing plate and an adjacent doorjamb, and (d) a quantity of self-tapping screw threaded means having a diameter adapting them to form a secure thread in a bore in said reinforcing plate formed by said drill bit.

14. A kit in accordance with claim 13 wherein the self-tapping screw threaded means are one-way screw means.

15. A kit in accordance with claim 13 additionally comprising:

(e) wedge-type plate positioning means adapted to wedge the reinforcing plate against a doorjamb by contact with a door frame when said reinforcing plate is placed in a customary space between the door frame and the door jamb.

16. A kit in accordance with claim 15 wherein the self-tapping screw threaded means are one-way screws means.

17. A kit in accordance with claim 15 additionally comprising:

(f) a striker plate adapted for attachment to said reinforcing plate by threaded means.

18. A kit in accordance with claim 17 additionally comprising:

(g) reinforcing fastening means comprised of:

(i) a central body portion having substantially planar first and second ends, (ii) a self-tapping threaded means extending from the first end and having a substantially smaller diameter than the central body portion, and (iii) a threaded orifice in the opposite second end of said central body portion.

19. A kit in accordance with claim 18 wherein there are two different width reinforcing plates in the kit.

20. A kit in accordance with claim 19 wherein there are two different striker plates in the kit and the self-tapping screw threaded means are one-way screw means.

* * * * *